United States Patent [19]

Stone

[11] 4,242,724

[45] Dec. 30, 1980

[54] DISPOSABLE FLOATING FLASHLIGHT

[76] Inventor: Wilfred S. Stone, 204-6 S. 13th Ave., St. Charles, Ill. 60174

[21] Appl. No.: 34,066

[22] Filed: Apr. 27, 1979

[51] Int. Cl.[3] ..... F21L 7/00

[52] U.S. Cl. ..... 362/158; 362/189; 362/205

[58] Field of Search ..... 362/158, 189, 205

[56] References Cited

U.S. PATENT DOCUMENTS 3,796,869 3/1974 Stone ..... 362/84

*Primary Examiner*—Stephen J. Lechert, Jr.

*Attorney, Agent, or Firm*—August E. Roehrig, Jr.

[57] ABSTRACT

A disposable, floating electric flashlight that glows in the dark and is illuminated by merely squeezing the flashlight casing. Any external switch actuator passing through the flashlight casing is thereby eliminated facilitating buoyancy. When the flashlight is illuminated, phosphorescent material within the internal walls of the flashlight casing is regenerated to cause the flashlight to glow in the dark. If the flashlight is accidentally dropped into water, the lamp is balanced to float the flashlight in a predetermined orientation to enable the glowing light to be quickly retrieved.

12 Claims, 6 Drawing Figures

IT FLOATS
IN THE DARK
TO BE FOUND

DISPOSABLE FLOATING FLASHLIGHT

BACKGROUND OF THE INVENTION

This invention relates in general to a floating electric flashlight and, in particular, to a floating electric flashlight that glows in the dark and requires no external switch control for actuation.

More specifically, but without restriction to the particular use which is shown and described, this invention relates to a luminescent floating electric flashlight that will float in a predetermined orientation in the event that the flashlight is dropped into water, allowing the flashlight to be quickly retrieved and protecting the internal components from submersion.

In many types of water activities, for example boating or fishing, the recreational activity is pursued in early morning or late-night hours. When fishing for certain kinds of fish, the absence of sunlight is essential and, with other species, night fishing yields the best results. However, even though fishing at night and working in the dark, the fisherman requires some light to change lures, bait hooks, and, hopefully, to remove fish therefrom. For example, fisherman often use artificial lures which are of various sizes, shapes and colors. These lures are an expensive item, and are usually changed frequently until the most effective lure is found. To prevent the lure from being disconnected from the fisherman's line while the lure is in the water, or when a fish strikes, the fisherman needs light to make certain his lure is secured to his fishing line.

During night fishing a flashlight is generally required so that the fisherman can conduct these activities. Since the fisherman needs to use both of his hands to accomplish these aforementioned tasks, he needs a flashlight that can be conveniently operated and will give off enough light. The present invention provides such a flashlight. The flashlight is very small, but provides a directed light beam sufficient to perform these activities. The flashlight has an internal switch that is activated by merely squeezing the flashlight housing. This internal switch allows the fisherman, for example, to place the flashlight between his front teeth and gently bite the casing thereby illuminating the flashlight, directing the beam of light where desired, and still have the free use of both of his hands.

In the event the flashlight falls into the water, an internal balanced-bouyancy air chamber will float the flashlight in a predetermined orientation for easy retrieval. To further insure that the flashlight can be readily seen floating in the water, the internal flashlight walls are coated with a phosphorescent material so that the flashlight glows in the dark after it has been illuminated. Since the phosphorescent material is on the flashlight walls, the flashlight is designed to float in a horizontal position so that the glow given off by the phosphorescent material is readily visable to the fisherman.

To maintain the buoyancy of the flashlight in a predetermined horizontal position, a plastic spacer band is inserted into the flashlight casing, which forms the air or flotation chamber, to position the internal components of the flashlight to achieve the desired weight balancing. The fisherman will, thus, easily spot the flashlight in the water and retrieve it because of the luminosity of the phosphorescent material present within the flashlight. The outer casing or housing of the flashlight is made of a plastic material and sufficiently sealed to prevent water damage to the internal components of the flashlight from submerging the flashlight in water for a period of time.

SUMMARY OF THE INVENTION

It is, therefore, an object of this invention to improve floating flashlights.

Another object of this invention is to utilize an internal switch control illumination of the flashlight.

A further object of this invention is to float the flashlight in a predetermined orientation in the event that the flashlight is dropped into a body of water.

Still another object of this invention is to seal the internal components of the flashlight to prevent internal water damage.

DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein.

DESCRIPTION OF THE PREFERRED EMBODIMENT

Figures 1, 2, 3, 4, 5, 6:
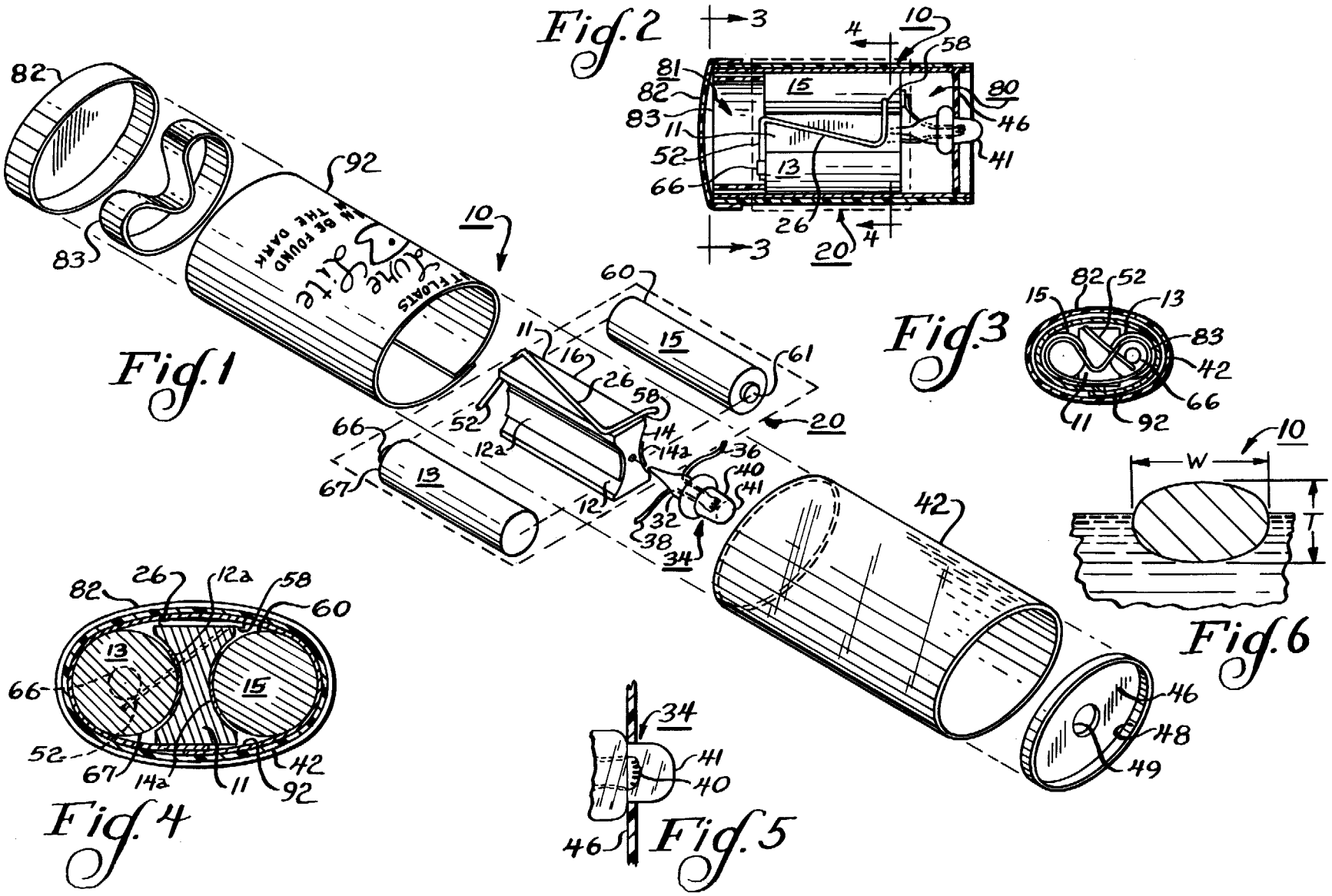
FIG. 1 is an exploded view of the flashlight assembly prior to assembly.
FIG. 2 is a longitudinal view of the flashlight after it has been assembled.
FIG. 3 is a sectional view taken along line 3—3 of FIG. 2.
FIG. 4 is a sectional view taken along line 4—4 of FIG. 2.
FIG. 5 is an enlarged view of a part of the light bulb assembly used in this invention.
FIG. 6 is an end view of the flashlight assembly showing the position in which the flashlight will float in water.

Referring now to FIG. 1, there is shown an exploded view of a disposable, water-resistant, electric flashlight 10. The flashlight 10 includes a transparent or translucent case 42, made of a flexible and resilient type insulating material, and closed at one end by a panel 46 forming a seal having a peripheral rim 48 and a central hole 49. The flashlight 10 further includes a chassis 20, which is inserted into the case 42, which includes a core 11, formed of electrically non-conductive material, bare can batteries 13 and 15, which are seated in arcuate channels 12 and 14 formed in the core 11, a light bulb 34 and a switch wire 26. The batteries 13 and 15 are secured to the channels 12 and 14 by means of a double sided adhesive tape **12*a* and 14*a*, respectively. One end 52 of the switch wire 26 is electrically connected (preferably by welding) and supported as a cantilever from a terminal 66 of the battery 13 (best shown in FIG. 3) with the switch wire 26 extending longitudinally across an upper face 16 of the core 11. The free end 58 of the switch wire 26 is located a small fraction of an inch above a can 60 of the battery 15 (best shown in FIG. 4). The light bulb 34 has lead connections 36 and 38 which are connected to a terminal 61 of the battery 15, and a can 67 of the battery 13**, respectively, preferably by welding.

In order to illuminate the light bulb 34, a slight pressure on the outside of the case 42 will deflect the case and cause the free end 58 of the switch wire 26 to contact the can or wall 60 of the battery 15. The closing of the free end 58 of the switch wire 26 against the can 60 completes an electrical circuit to supply power to drive a light bulb filament 40, thereby illuminating the light bulb 34.

In order for the flashlight 10 to have the sufficient luminary capabilities to allow it to glow in the dark, a sleeve 92, coated on the outside with a phosphorescent material, is inserted over the flashlight chassis 20, and then the entire assembly is inserted into the plastic case 42. When the chassis 20 and the sleeve 92 are inserted in the case 42, an outer tip 41 of the light bulb 34 will pass through the hole 49 of the panel 46 (as shown in FIG. 5) and is sealed thereagainst.

The light bulb 34 has a glass base 32 which conducts some of the light given off from the filament 40 into a regenerative chamber 80. The light in this chamber 80 will regenerate the phosphorescent material coated on the outside of the sleeve 92, thereby providing a luminous afterglow of one to ten hours. The light bulb 34, therefore, performs not only a normal lighting function, but also regenerates the phosphorescent material on the sleeve 92 to permit the flashlight 10 to glow in the dark. For a more detailed description of the operation of the flashlight, its luminosity capabilities, and the internal switch mechanism reference is made to W. S. Stone, U.S. Pat. No. 3,796,869, the disclosure of which is incorporated herein by reference. The flashlight 10 is made water-resistant by closing the open end of the case 42, with a cap 82 and sealing the cap 82 thereto, for example, by an adhesive or by melting the edges with heat. The flashlight described herein is in the nature of a throw-away item and will function as long as the batteries 13 and 15 last, which have a shelf life of about one to two years.

While the closed case 42 of the flashlight 10 is thereby sealed to prevent the entrance of water into the flashlight 10 for a long period of time, it is desirable that a sufficient volume of air be sealed within the unit to allow the flashlight to float. In order to sufficiently buoy the flashlight 10, there is provided a balancing air chamber 81, which is located adjacent to the cap 82, and the regenerative chamber 80, which is positioned adjacent to the panel 46. The two chambers 80 and 81, in combination with the air space therebetween surrounding the chassis assembly 20, form a casing flotation chamber. The volume of air in the balancing air chamber 81 and the regenerative chamber 80, is substantially the same.

Since the chassis assembly 20 is the only component of any significant weight in the flashlight, positioning the chassis 20 in the center of the flashlight centered between the two chambers 80 and 81, will permit the flashlight 10 to float in a predetermined horizontal orientation. Floating in a horizontal position with the phosphorescent material on the sleeve 92 above the level of the water, the glow of the flashlight will be readily seen, and the flashlight easily retrieved if dropped. This desired orientation in a horizontal position, is achieved by maintaining the chassis 20 in a fixed position with the air chambers 80 and 81 at each end thereby positioning the weight of the chassis 20 in the center of the flashlight 10.

In order to maintain the chassis 20 in this desired position, a spacer band 82, made of an insulating material, is inserted into the balancing air chamber 81 to maintain the chassis 20 in place. The spacer band 83 prevents movement of the chassis 20 within the flashlight 10, to maintain the desired weight balancing to insure that the flashlight 10 will float in the desired horizontal orientation. The weight of spacer band 83 in the air chamber 81, and the light bulb assembly 34 in the regeneration chamber 80, are both negligible when compared to the weight of the chassis 20. Since the width of the flashlight 10, as denoted by W. in FIG. 6, is substantially greater than the thickness of the flashlight 10, denoted by T in FIG. 6, the flashlight 10 will float in a horizontal orientation as shown in FIG. 6 on its widest dimension.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A floating electric flashlight including a sealed water-resistant casing defining a flotation chamber and including an air chamber portion at each end of said casing having substantially equal volumes of air confined therein for maintaining and balancing the flotation of said flashlight in a predetermined orientation when placed in water, electrical energy producing storage means for providing a source of electrical energy and an electrically energizable light bulb carried within said casing, said storage means and said light bulb coupled into an electrical circuit for connecting the electrical energy from said storage means to said light bulb for effecting the illumination thereof, and normally open switch means carried entirely within said casing, and coupled into said electrical circuit and operable into a closed position upon flexing said casing for coupling the electrical energy from said storage means to said light bulb thereby effecting the illumination thereof.

2. The apparatus of claim 1 wherein a portion of said light bulb carried within said casing extends outwardly therefrom to direct a light beam emanated thereby.

3. The apparatus of claim 1 wherein said casing comprises a resilient electrically insulating material.

4. The apparatus of claim 1 wherein said electrical energy producing storage means comprises at least first and second electrically coupled batteries carried within said case, each of said batteries having an electrically conducting can acting as one terminal thereof and a terminal post acting as a second terminal of opposite electrical polarity and electrically isolated from said can, said electrically energizable light bulb includes a pair of electrical terminals, each one of said terminals being mutually exclusively electrically coupled to a terminal of opposite polarity of each of said batteries, and said normally open switch means carried entirely within said casing comprises a resilient electrically conducting cantilevered switch wire having one end electrically coupled to and supported from one terminal of one of said batteries, and an opposite free end extending to a position normally adjacent to and spaced from a terminal of opposite polarity of the other of said batteries.

5. The apparatus of claim 4 wherein said resilient electrically conducting cantilevered switch wire is carried adjacent said casing such that said switch wire is closed into electrical contact with said adjacent normally spaced battery terminal to illuminate said flashlight bulb upon the flexing of said casing.

6. The apparatus of claim 4 wherein one end of said resilient electrically conducting cantilevered switch wire is secured to the terminal post of said first electrically coupled battery, and the free end thereof extends to a position adjacent to but spaced from the electrically conducting can of said second electrically coupled battery, such that upon flexual movement of said casing said resilient electrically conducting cantilevered switch wire will close said electrical circuit for illuminating said light bulb.

7. The apparatus of claim 4 wherein the electrical terminals of said electrically energizable light bulb comprise first and second flexible electrical conductive leads, said first electrically conductive lead being secured to the can of said first electrically coupled battery, and said second electrically conductive lead being secured to the terminal post of said second electrically coupled battery.

8. The apparatus of claim 4 wherein said sealed, water-resistant casing extends a length greater than said batteries and said batteries are positioned intermediate the ends of said casing to thereby define two air-retaining chambers extending between each end of the batteries and the end of said casing.

9. The apparatus of claim 8 further including phosphorescent material carried within said flotation chamber such that upon illumination of said light bulb said phosphorescent material will luminesce.

10. The apparatus of claim 9 wherein a portion of said light bulb is positioned within one of said-retaining chambers positioned contiguous the ends of said batteries to define a regeneration chamber for regenerating the phosphorescence of said luminescent material upon energization of said light bulb.

11. The apparatus of claim 10 wherein said other air-retaining chamber portion opposite to said regeneration chamber forms a balancing air chamber and contains an electrically insulating spacer for preventing movement of said batteries within said casing.

12. The apparatus of claim 11 wherein said regeneration chamber and said balancing air chamber contain substantially equal quantities of air for maintaining said flashlight in a predetermined orientation when placed in water.

* * * * *